US006550403B2

(12) United States Patent
Dressendorfer et al.

(10) Patent No.: US 6,550,403 B2
(45) Date of Patent: Apr. 22, 2003

(54) SHELVING CASE ASSEMBLY FOR SIMULTANEOUSLY STORING INDIVIDUAL AND MIXED DIFFERENT SIZED INFORMATION MODULES

(76) Inventors: Michael R. Dressendorfer, 352 Rebecca Dr., San Dimas, CA (US) 91733; Bernard A. Higuera, 14359 Spring Dr., Chino Hills, CA (US) 91709

( * ) Notice: Subject to any disclaimer, the term of this patent is extended or adjusted under 35 U.S.C. 154(b) by 0 days.

(21) Appl. No.: 09/828,361

(22) Filed: Apr. 7, 2001

(65) Prior Publication Data

US 2002/0144634 A1 Oct. 10, 2002

(51) Int. Cl.[7] ..... A47B 11/00
(52) U.S. Cl. ..... 108/102; 108/143
(58) Field of Search ..... 108/107, 102, 108/59, 61, 143; 211/162, 151; 312/198, 200, 201; 248/188.4, 188.8, 188.9

(56) References Cited

U.S. PATENT DOCUMENTS 2,680,326 A * 6/1954 Sultan
3,592,423 A * 7/1971 Mui
5,072,838 A * 12/1991 Price, Jr. et al.
5,205,627 A * 4/1993 Davison et al.
5,226,549 A * 7/1993 Price, Jr. et al.
5,341,944 A * 8/1994 Latino
RE35,047 E * 10/1995 Potter
5,533,457 A * 7/1996 Cox
5,624,166 A * 4/1997 Theken et al.
5,899,422 A * 5/1999 Eke
5,943,967 A * 8/1999 Sherman
5,967,346 A * 10/1999 Price, Jr.
5,967,472 A * 10/1999 Wilhelmstatter et al.
6,349,907 B1 * 2/2002 Hollington et al.

FOREIGN PATENT DOCUMENTS

GB 2061860 A * 5/1981

* cited by examiner

*Primary Examiner*—Jose V. Chen
(74) *Attorney, Agent, or Firm*—George Netter

(57) ABSTRACT

A shelving case assembly (10) includes two or more rows of shelving cases (12), certain of which are movable to enable access to both front row cases and those behind for storing or retrieving information modules (14). Movable cases include rollers (38) on a bottom panel that have constrained movement along a pedestal channel (42) and upper guide means (44) maintaining upright relation to immovable cases (32). A cover plate (76) is held securely in place on a floor surface by a pedestal (40).

8 Claims, 3 Drawing Sheets

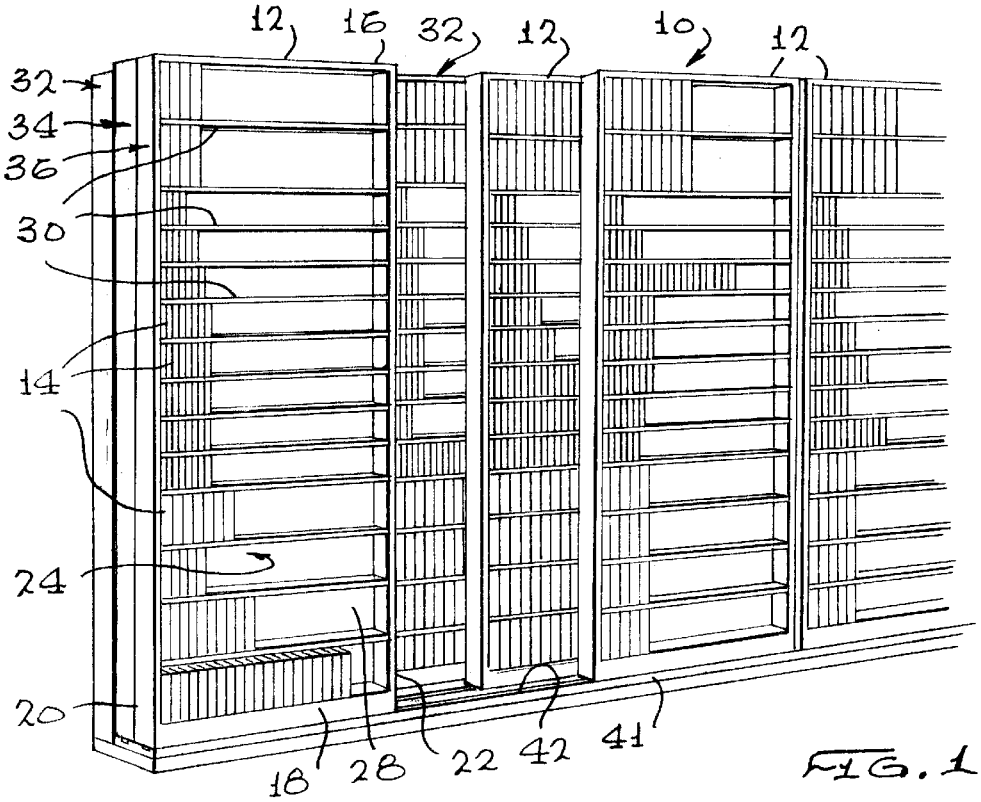
FIG. 1
FIG. 2
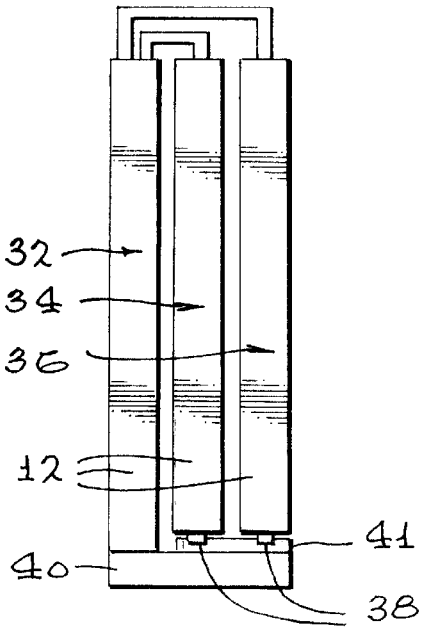
FIG. 4
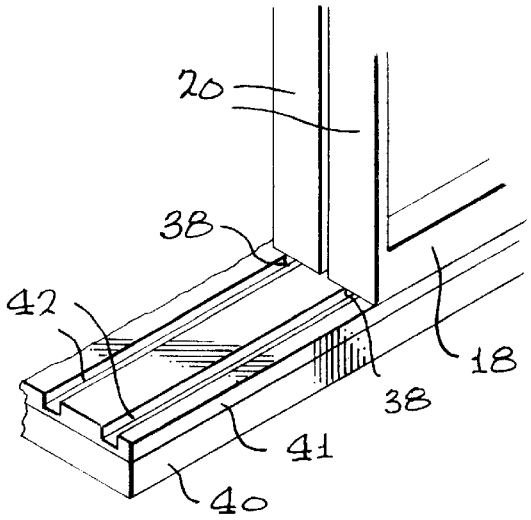

SHELVING CASE ASSEMBLY FOR SIMULTANEOUSLY STORING INDIVIDUAL AND MIXED DIFFERENT SIZED INFORMATION MODULES

BACKGROUND

1. Field of the Invention

The present invention relates generally to a shelving case assembly in which a plurality of such cases are movable with respect to each other providing access to stored information modules of individual or mixed, uniform or widely different sizes. Individual cases in an assembly can be of differing depth dimensions to achieve appropriately desirable accommodation of the different sized modules.

2. Description of Related Art

At the present time there are a large number of information modules of correspondingly different sizes (e.g., mini-DV; 4 mm; 8 mm; small DVC Pro; DLT, no box; small DV-Cam; audio cassette; DLT, in box; large DVC Pro; large DV Cam; small Beta; VHS, in sleeve, to name a few) making the storage of such modules a complex procedure if they are to be stored together in one system. Moreover, the storage system should desirably be sufficiently flexible so that the storage of a given mix of modules can be simply and quickly changed to a different mix. One answer to this problem is U.S. Pat. No. 4,657,317, STORAGE ASSEMBLY has a number of individual cabinets including storage panels or drawers in which information modules may be supportingly stored. Specifically, the storage drawers can be rolled into a cabinet for storage or retracted for access to stored modules.

The patented storage assembly is an exemplary answer to information module storage, however, it is desirable to enhance the ability to store modules of different dimensions either individually or mixed on the same drawer shelves. Moreover, the patented cabinets are fixedly arranged with respect to each other requiring dedication of a relatively large amount of room and wall space to accommodate the assembly, and it would be desirable to reduce both dimensions as well as overall weight.

SUMMARY OF THE INVENTION

It is a primary aim and object of this invention to provide an improved assembly of selectively dimensioned shelving cases adapted for vertically upright use, certain of which cases are movable from covering to uncovering relation with respect to other cases.

Another object as in the first object provides roller means aiding movement of the cases and sliding guide means interconnecting the cases for maintaining a predetermined desired minimum spaced apart relation between cases.

Yet another object is the provision, in combination with the previous objects, of overhead interconnecting means between cases enabling relative movement of predetermined character.

Another object is the provision of an improved self-adjusting floor gap covering means.

BRIEF DESCRIPTION OF THE DRAWING

These and other objects of the present invention will become more readily apparent upon reading the following detailed description and upon reference to the attached drawings:

FIG. 1 is a perspective view of an assembly of module storage shelving cases forming the base system of the present invention;

FIG. 2 is an end elevational view of the assembly of FIG. 1;

FIG. 4 is a perspective, partially fragmentary, view of several cases as mounted for rolling movement on a pedestal;

DESCRIPTION OF PREFERRED EMBODIMENTS

Figure 3:
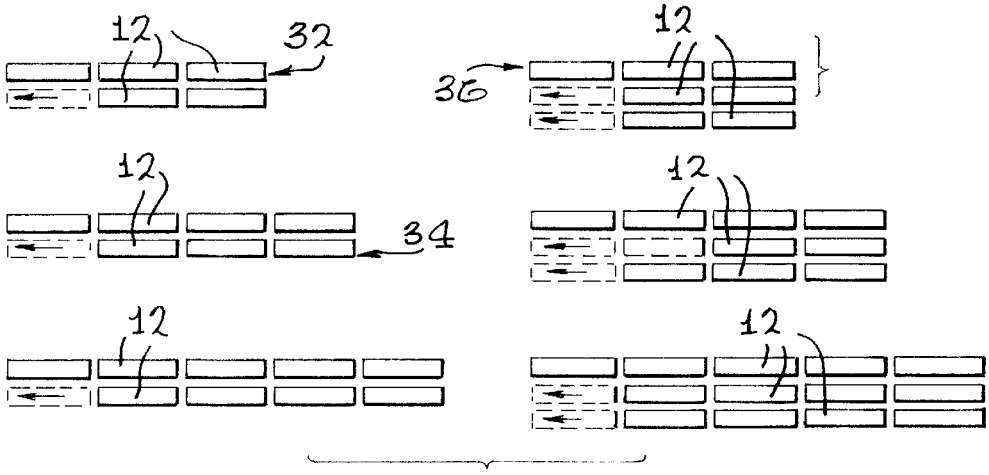
FIG. 3 is a schematic top plan view of different numbers of individual shelving cases that can be assembled in accordance with the described invention.

Reference is now made to the drawings and particularly to FIG. 1 where a shelving case assembly 10 is shown including generally a plurality of upstanding shelving cases 12 which, in a way that will be described, can be individually moved with respect to each other to enable access to any drawer cabinet to add an information module 14 to or remove it from storage therein.

Each shelving case 12 includes a generally rectangular top panel 16, a bottom panel 18, and two side panels 20 and 22, all of which are end secured to form a unitary overall parallelepiped construction. A front major side 24 for each case is open enabling ready access for storage of information modules 14 or retrieval of previously stored modules therefrom. The back or rear major side of each shelving case is preferably enclosed by a wall 28. As the panel names suggest, the cases are used throughout in upright arrangement supported by the bottom panel 18.

A number of generally horizontal shelves 30 are end connected to the side panels 20 and 22 to extend therebetween providing support for modules 14 restingly stored thereon. Although a number of different shelves can be employed for this purpose, best results are obtained with shelving that can accommodate modules of different dimensions and which shelving provides means for forming a common forwardmost edge of the modules none of which protrude outwardly from the shelving case. Excellent results can be obtained from utilizing shelving as described in co-pending patent application assigned to the same assignee as the subject application for MODULAR STORAGE DRAWER AND ADJUSTABLY VARIABLE SHELVING THEREFOR by Michael Dressendorfer et al.

For an overall shelving case assembly operation, reference is made simultaneously to FIGS. 2 and 3. A preferred system is seen to include three rows 32, 34 and 36 of individually edge aligned shelving cases 12 arranged in front-to-back stacked arrangement. Specifically, the cases of row 32 are immovably secured to a generally parallelepiped pedestal 40 typically secured to a horizontal floor surface. The cases of rows 34 and 36 are selectively movable generally parallel to the respective case rectangular planes in a way and for a purpose to be described.

With particular reference to FIG. 3, there is shown in plan view various configurations of shelving cases possible in accordance with the present invention, where the topmost row as depicted of each configuration is a back row 32 immovably secured to a base and the other two rows are movable laterally where space is available. The dash-line rectangles with an arrow each indicate a space where no case is present and represents a space into which an adjacent case may move into. Whether a two-row or three-row configuration, selective transverse shifting of the shelving cases into available spaces permits access to the front or major open side 24 of any case.

For the ensuing description of the apparatus enabling lateral movement of those shelving cases 12 comprising movable rows 34 and 36, reference is additionally made to FIG. 4. Adjacent the interconnection of each side panel 20 and 22 with the bottom panel 18, there is journaled a roller 38 onto a lower surface of the bottom panel. A specially constructed guide 41 on the pedestal 40 includes a channel 42 extending substantially the full length of the bottom panel 18 for receiving a shelving case roller 38 and guiding it during rolling movement of the cabinet. By this construction, each shelving case is constrained to move along a path defined by a channel 42 within which the roller 38 is received. It is contemplated that case movement will be manually produced.

Figure 5:
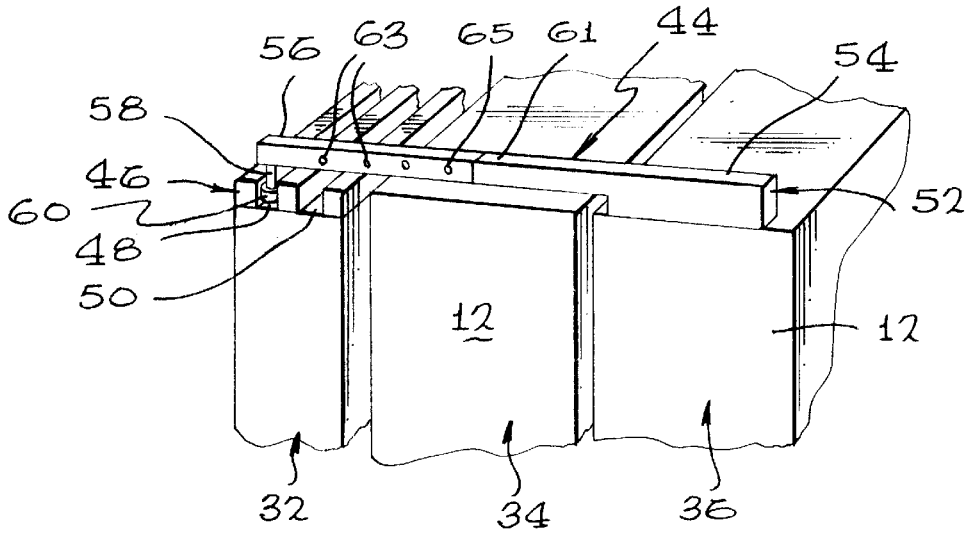
FIG. 5 is an enlarged partially fragmentary view of a guiding means for the shelving cases.

As can be seen best in FIGS. 1 and 5, there is also provided an upper guide means 44 interrelating each movable shelving case (e.g., those in rows 34 and 36) with the immovable drawers (e.g., those in row 32) for maintaining the upright position of the cases during movement. Specifically, the means 44 includes a guide body 46 secured to the outer top wall of each of the immovable cases in row 32, the outer surface of which has first and second parallel spaced apart slotted tracks 48 and 50 extending over the entire number of immovable cases. A generally L-shaped guide member 52 has its cross-arm 54 secured to the upper outer surface of a top panel of a shelving case in the row 36 with its other arm 56 extending over and spaced from any intervening case in row 34. The outer terminus of arm 56 has a spindle 58 extending downwardly into slotted track 48 with a roller 60 journaled thereto. Each case in row 34 also includes a similarly constructed guide member 52 with a spindle and roller received within the slotted track 50 (not shown). The guide members 52 serve to maintain the shelving case in an upright, generally parallel relationship to each other throughout use while enabling relative movement as needed or desired.

As shown in FIG. 5, the guide member other arm 56 is telescopingly secured to the cross-arm portion 54 at 61 and includes a plurality of openings 63 therethrough for providing an overall extension length maintained by pin means 65 received therein. This adjustment means enables using cases 12 of different thicknesses (e.g., varying from 5 inches to 12 inches) in the same assembly.

In use, to store modules 14 on any given shelving case 12 the cases are shifted as shown in FIG. 3 until the major access or front side 24 of the given shelving case is exposed and the module is then located on a desired shelf 30. The process is the same when access to a given shelving case is desired to retrieve one or more modules.

In the description given to this point, the front-to-back thickness T of the shelving cases 12 has not been specifically discussed and it can be assumed that in one embodiment of the invention all of the cases are the same and that front-to-back adjacent cases are mounted with a minimum spacing in order that they may be moved as described without obstructing each other. However, it is contemplated that an assembly 10 may be constructed from a plurality of cases of two or more different case thicknesses. Practical case constructions have been made of thicknesses T varying from approximately 5 inches to 12 inches.

Figure 6:
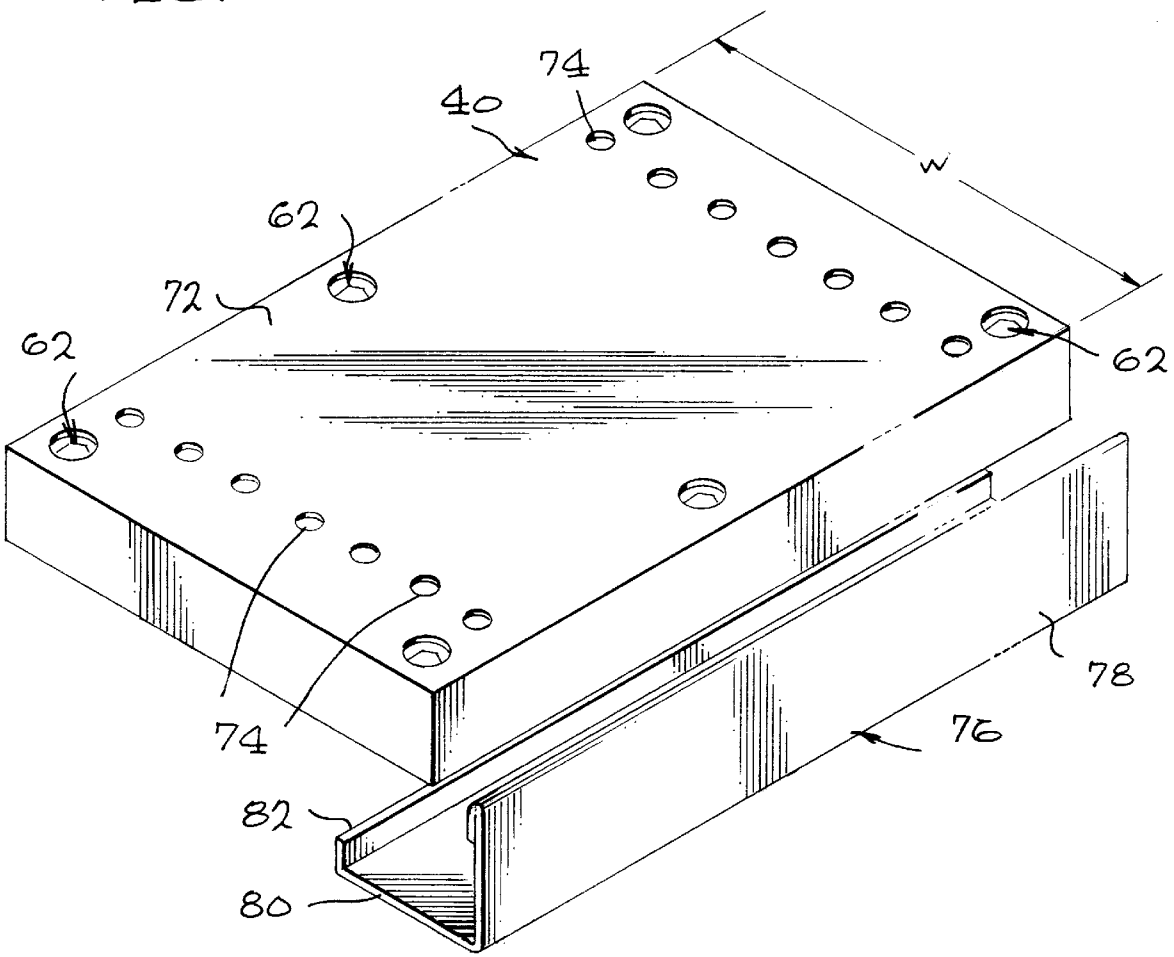
FIG. 6 is a perspective view of the pedestal with leveling means and floor gap covering means.

Since it is desirable to have the system 10 mounted relatively precisely horizontal to prevent significant shelving case self-movement, as well as to avoid the undesirable condition of a case moving force being substantially greater in one direction than in another, the pedestal is adjustable. The pedestal 40 is seen in FIG. 6 to be generally rectangular and include preferably six (6) separate height adjustment means 62, three along one long edge of the pedestal and a remaining three along the other parallel long edge. Each height adjustment means 62 includes a threaded rod 64 with a configured outer head 66 for tool reception (e.g., hex-headed) and a glide 68 on the opposite end. Each means 62 is threaded onto an inner wall 70 of the pedestal and can be individually adjusted vertically to accommodate any unevenness of the underlying floor. The top surface 72 of the pedestal includes a plurality of predetermined spaced apart openings 74 arranged in preferably two or more different lines across the width W which are used to mount guides 41 of the different shelving cases to the pedestal in appropriately spaced relation.

Figure 7:
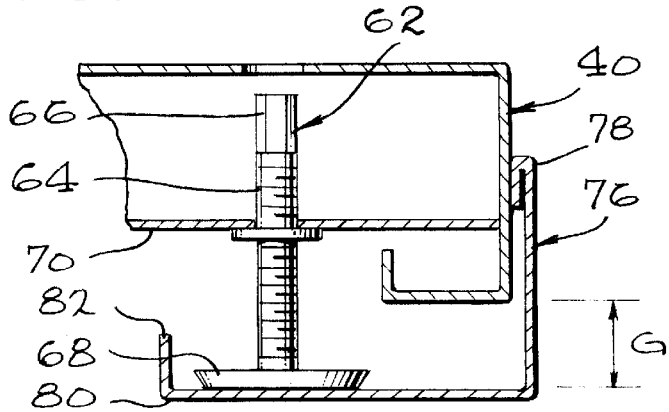
FIG. 7 is a sectional view of FIG. 6 showing details of the leveling means and floor gap covering means.

A generally L-shaped cover plate 76 is slidable under the front facing surface of the pedestal to cover any mounting "gaps" that may be formed during leveling adjustments. Specifically as best shown in FIG. 7, the upright wall 78 of plate 76 extends upwardly on assembly to cover a gap G between the pedestal front wall and the floor surface (not shown). The base wall 80 of plate 76 has a turned up terminus 82 which, when the glide/s of one or more leveling means 62 rest on the base wall 80, prevents the cover plate from inadvertently being moved out of covering relation to the gap G.

Although the present invention is described in connection with preferred embodiments, it is to be understood that those skilled in the appertaining arts may contemplate modifications that come within the spirit of the invention as described and within the ambit of the appended claims.

What is claimed is:

1. An information module storage assembly, comprising:

pedestal means for mounting onto a generally horizontal surface;

a plurality of shelving cases each having a major access side and a lower mounting panel received onto the pedestal means with the access sides facing in a common direction, certain of said shelving cases blocking access to certain other of the shelving cases;

roller means interconnecting the lower mounting panels of the certain shelving cases blocking access to the certain other shelving cases enabling movement of said certain cases to an unblocking relation; and a generally L-shaped plate slidably positioned at an access side of the assembly to cover any floor gap along a side of the pedestal, said plate having a base wall located under the pedestal, a height adjustment means contacting the base wall, and a wall extending upwardly in partial covering relation to the pedestal.

2. An information storage assembly as in claim 1, in which a plurality of separate height adjustment means are mounted to the pedestal means.

3. An information storage assembly as in claim 2, in which each height adjustment means includes a threaded member with one end configured for gripping by a tool and the other end terminates in a glide.

4. An information storage assembly as in claim 1, in which the base wall includes an edge portion formed upwardly away from the base wall obstructing inadvertent sliding removal of the base plate from under the height adjustment means.

5. An information storage assembly as in claim 1, in which the front to back thickness dimension of at least one shelving case differs from the thickness dimensions of the remaining shelving cases.

6. An information module storage assembly, comprising:

pedestal means for mounting onto a generally horizontal surface;

a plurality of shelving cases each having a major access side and a lower mounting panel received onto the pedestal means with the access sides facing in a common direction, certain of said shelving cases blocking access to certain other of the shelving cases which are fixedly secured to the pedestal means, said certain of said shelving cases being arranged in at least one row in front of a single row of the certain other shelving cases;

roller means interconnecting the lower mounting panels of the certain shelving cases blocking access to the certain other shelving cases enabling movement of said certain cases to an unblocking relation;

a channel on the pedestal receiving part of the roller means therein to control the direction of movement of a shelving case; and a guide means is fixedly secured to an upper part of each said certain shelving case and also movably and guidingly interconnected with said certain other shelving case.

7. An information storage assembly as in claim 6, in which the upper guide means includes a separate slotted track for each row of certain shelving cases mounted onto the certain other shelving cases, and a guide member having a first end secured to a certain shelving case member and a second end located within a slotted track.

8. An information storage assembly as in claim 7, in which the guide member first and second ends are telescopingly related and include a plurality of spaced apart openings for adjusting overall length of the guide member.

* * * * *